United States Patent [19]

Howell et al.

[11] 3,992,854

[45] Nov. 23, 1976

[54] METHOD AND APPARATUS FOR MAKING DUAL COMPARTMENT PACKAGE

[75] Inventors: Duane Aaron Howell, Davenport, Iowa; David G. Walton, Washington, Ill.

[73] Assignee: The Kartridg Pak Co., Davenport, Iowa

[22] Filed: Feb. 18, 1976

[21] Appl. No.: 659,102

[52] U.S. Cl. ..... 53/14; 53/28; 53/133; 53/180 M

[51] Int. Cl.[2] ..... B65B 9/12; B65B 51/05; B65B 61/02

[58] Field of Search ..... 53/14, 28, 133, 138 A, 53/180 M, 182 M; 93/35 PC, 82; 206/219

[56] References Cited

UNITED STATES PATENTS

| | | | |
|---|---|---|---|
| 2,771,724 | 11/1956 | Hosier et al. | 53/29 X |
| 3,838,549 | 10/1974 | Pepmeier | 53/180 M |
| 3,861,522 | 1/1975 | Llewellyn et al. | 53/28 X |
| 3,915,297 | 10/1975 | Rausch | 206/219 |
| 3,918,235 | 11/1975 | Brown et al. | 53/28 |
| 3,935,048 | 1/1976 | Rucker | 93/82 X |

*Primary Examiner*—Robert Louis Spruill
*Attorney, Agent, or Firm*—Lockwood, Dewey, Zickert & Alex

[57] ABSTRACT

An apparatus for continuously producing a series of multi-compartment packages formed from a single web of pliable film material. The machine folds the web along one of its side edges to form a pocket or two-ply margin. The web is then passed through a tube former which bends the web across its width until a continuous tube is formed with the two-ply margin to the inside and overlapped by the opposing side edge of the web. The apparatus then seals the tube with a single composite seal across the overlapped portion of the tube, which is of three-ply thickness. Next, the apparatus positions differing substances in each compartment. Then, the apparatus sequentially gathers the filled tubular member at two positions along its length, seals the gathered portions by clinching pairs of closure clips therearound, and severs the film material between the clips in each pair thereof to form the package.

16 Claims, 14 Drawing Figures

FIG. 4
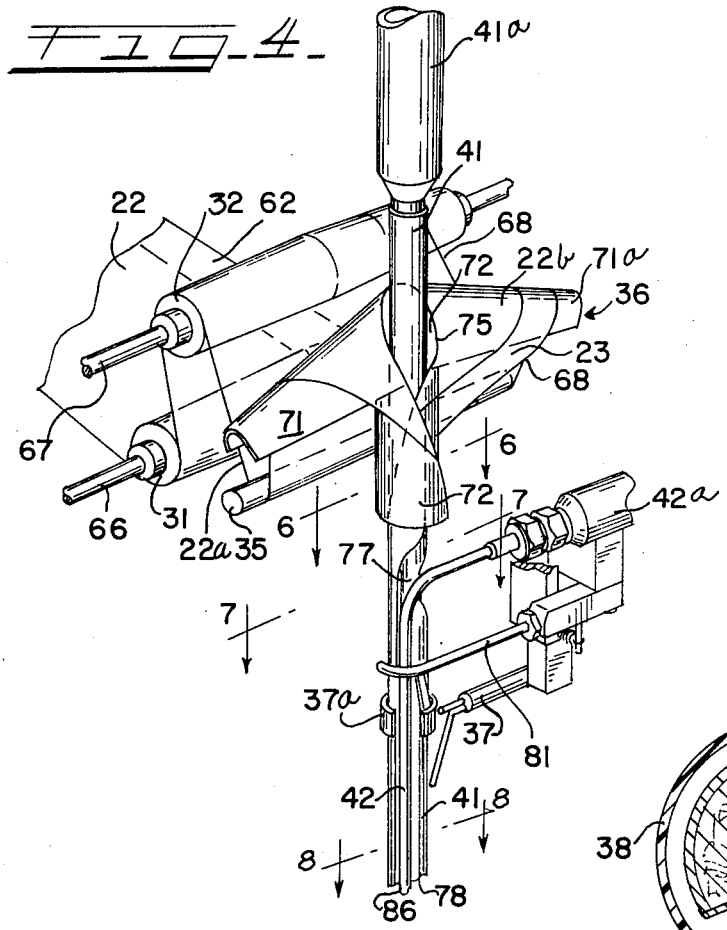
FIG. 6
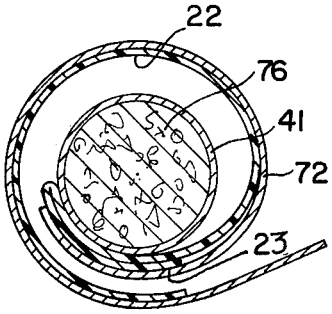
FIG. 7
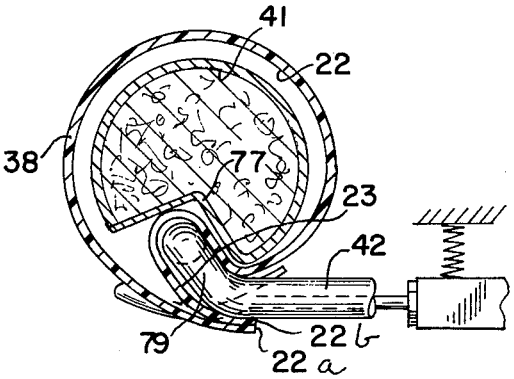
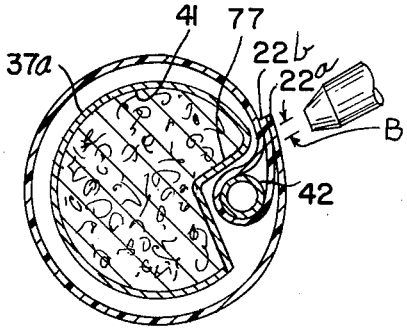
FIG. 8
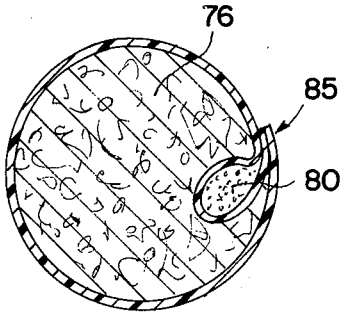
FIG. 9

FIG. 10
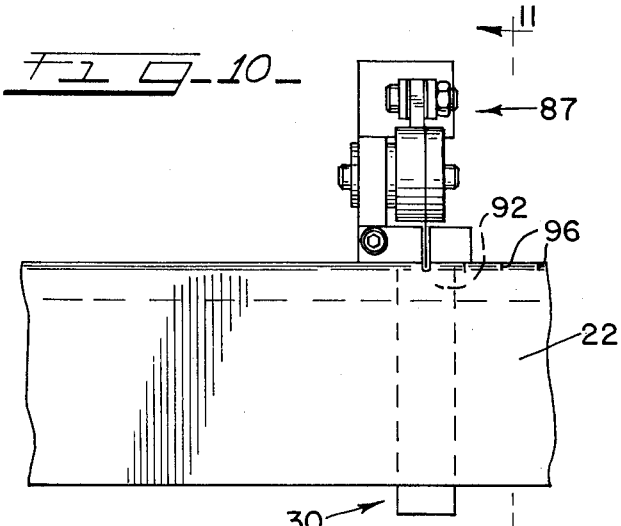
FIG. 11
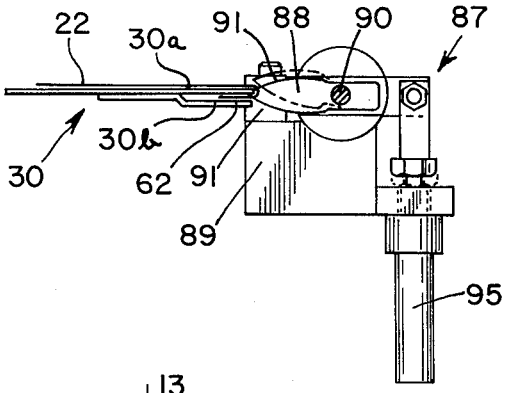
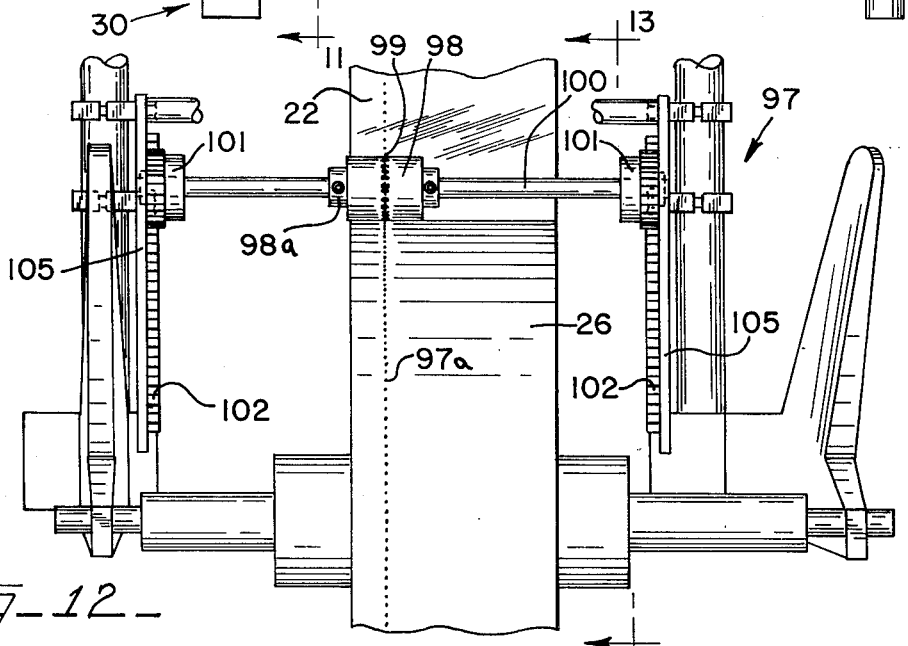
FIG. 12
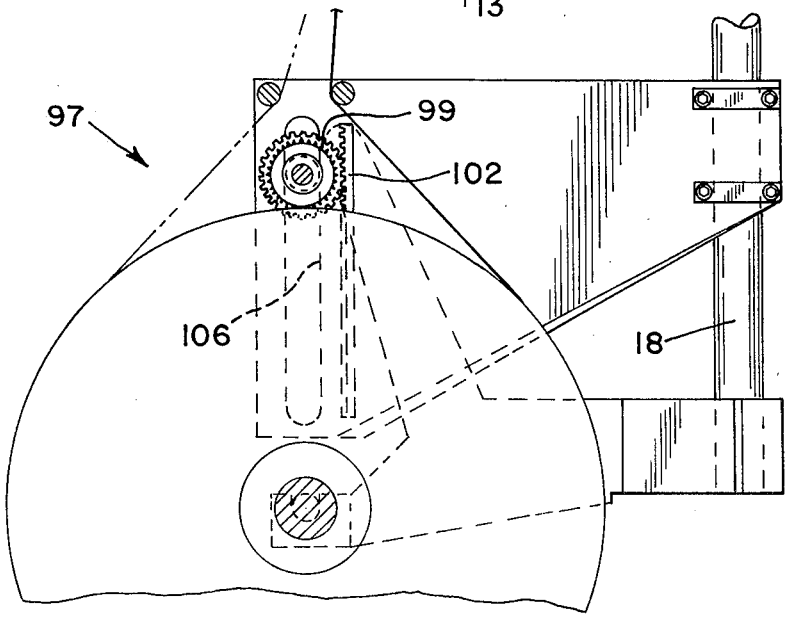
FIG. 13

METHOD AND APPARATUS FOR MAKING DUAL COMPARTMENT PACKAGE

This invention relates to packaging machinery and is more particularly concerned with improvements in a machine of the type which simultaneously forms a continuous tube of relatively thin pliable material, feeds a plurality of materials to be packaged into separate compartments therein and then constricts, seals, and severs the filled tube at intervals to divide the same into a plurality of separate individual multi-compartment packages.

Multi-compartment packages are known consisting of an inner compartment sealed within an outer compartment, e.g., an inner flexible envelope within an outer flexible envelope, both envelopes sealed along three or all four edges at the envelope's periphery. As described in U.S. Pat. No. 3,302,410, this type of package is slack, rather than rigid. The forming and filling of other dual compartment packages of this general overall design, e.g., those described in U.S. Pat. No. RE. 25,869 and U.S. Pat. No. 3,385,427, also entail complicated assembly procedures. Also, dual compartment packages may include a tubular member and an inner compartmentizing chordal diaphram. However, such packages require a plurality of spaced-apart sealing engagements which complicates the package making machinery. Also, these packages have at least one internal seal. If the inner engagement inadvertently fails before mixing is desired, the reaction takes place and all of the materials in the package are lost for future use. Such packages are described in U.S. Pat. Nos. 3,795,081, 3,861,522, and published application B417,299.

The apparatus forming the subject matter of this invention is the latest improvement in a family of continuous tubular package making machinery which originated with the apparatus of U.S. Pat. No. 2,831,302 patented Apr. 22, 1958. Improvements in the original apparatus are the subject matter of U.S. Pat. Nos. 3,149,447 and 3,324,621. Further improvements in the continuous packaging (chub) machine are the subject matter of U.S. Pat. No. 3,795,083 issued Mar. 5, 1974 to the assignee of the instant application. All the prior art patents mentioned above are directed to an apparatus which feeds a single substance into a continuously formed single compartment tubular member which is then constricted, sealed and severed at intervals to divide the same into a plurality of separate individual single compartment packages. The apparatus of the present invention feeds a plurality of differing substances into separate compartments in a continuously formed tubular member and then constricts, seals, and severs the multi-compartment tube at intervals to divide the same into a plurality of separate individual multi-compartment packages. The packages formed by the apparatus of the invention are the subject matter of a co-pending application, Ser. No. 628,477 filed Nov. 4, 1975 and assigned to the assignee of the instant application. The disclosure of that application is incorporated herein by reference.

The invention is directed to an apparatus for continuously forming series of packages of the type including a multi-compartment tubular member made from a single web of pliable film filled with differing substances in each compartment, gathered at two positions along its length, sealed at each gathered portion by pairs of closure clips clinched therearound, and severed between the closure clips in each pair thereof. The apparatus of the invention comprises a means for folding a portion of said web adjacent one side edge thereof over upon the remainder of said web forming a two-ply margin. The apparatus also comprises means for forming said web into a continuous tube with the opposing side edge of said web being on the outside thereof and overlapping said two-ply margin until said one side edge and said opposing side edge are in engaging registration. The apparatus further includes means for sealing together said two-ply margin and said opposing side edge with a single composite seal to form two separate compartments in said tube, means for filling each compartment in said continuously formed tube with a differing substance, and means for gathering portions of said tube, clinching pairs of closure clips around said gathered portion, and severing said pliable film between said closure clips.

It is an object of the invention to provide an improved apparatus for continuously producing the multi-compartment package which is the subject matter of co-pending application Ser. No. 628,447 filed Nov. 4, 1975 and assigned to the assignee of the instant application.

It is a further object of the invention to provide an apparatus for producing a continuous dual compartment tube from a one piece web of relatively thin pliable film wherein both compartments in the tube are formed by folding the web in a manner such that only a single sealing engagement along the length of the tube is needed to divide the same into separate compartments.

Another object of the invention is the provision of an apparatus for continuously forming a dual compartment tube wherein a second compartment is formed interiorly of a first compartment and attached to same longitudinally along a sidewall thereof, wherein the apparatus includes means for controllably decreasing the burst strength of the second compartment.

A still further object of the invention is the provision of an apparatus for folding a web of relatively thin pliable material forming a two-ply margin, and then concavely folding the web such that the two-ply margin is on the outside thereof and overlapping the opposing edges of the web to form a three-ply portion, and then sealing the three plies together adjacent the overlapped edges to continuously form a dual compartment tube, which is then filled, constricted, sealed, and severed at intervals along its length to divide the same into a plurality of separate dual compartment individual packages.

The features of the present invention, which are believed to be novel, are set forth with particularity in the appended claims. The invention may best be understood by reference to the following detailed description taken in connection with the accompanying drawings in the several figures of which like reference numerals identify like elements and in which:

Figure 2:
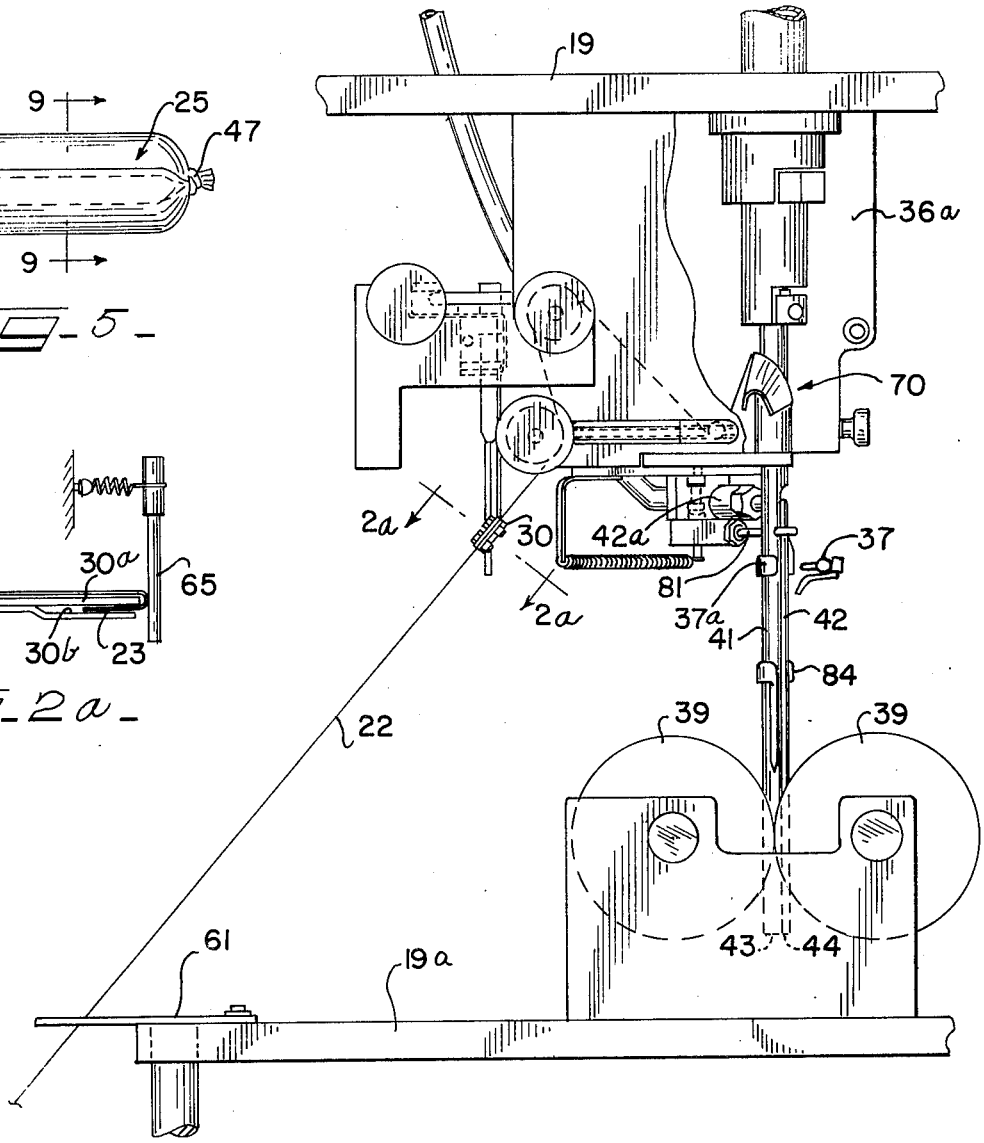
FIG. 2 is a front-elevational view, with portions cutaway for clarity, of the tubular member forming and filling portion of the complete apparatus shown in FIG. 1.
Figure 2:
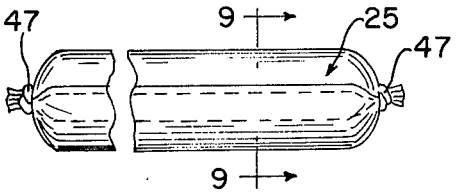
Figure 2A:
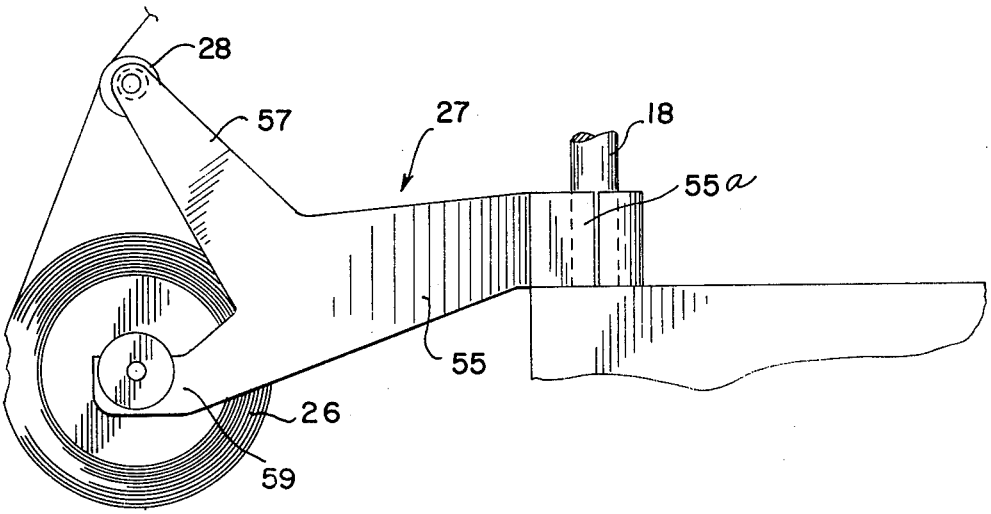

FIG. 2*a* is an enlarged detail sectional view taken substantially along line 2*a*–2*a* of FIG. 2.

Figure 1:
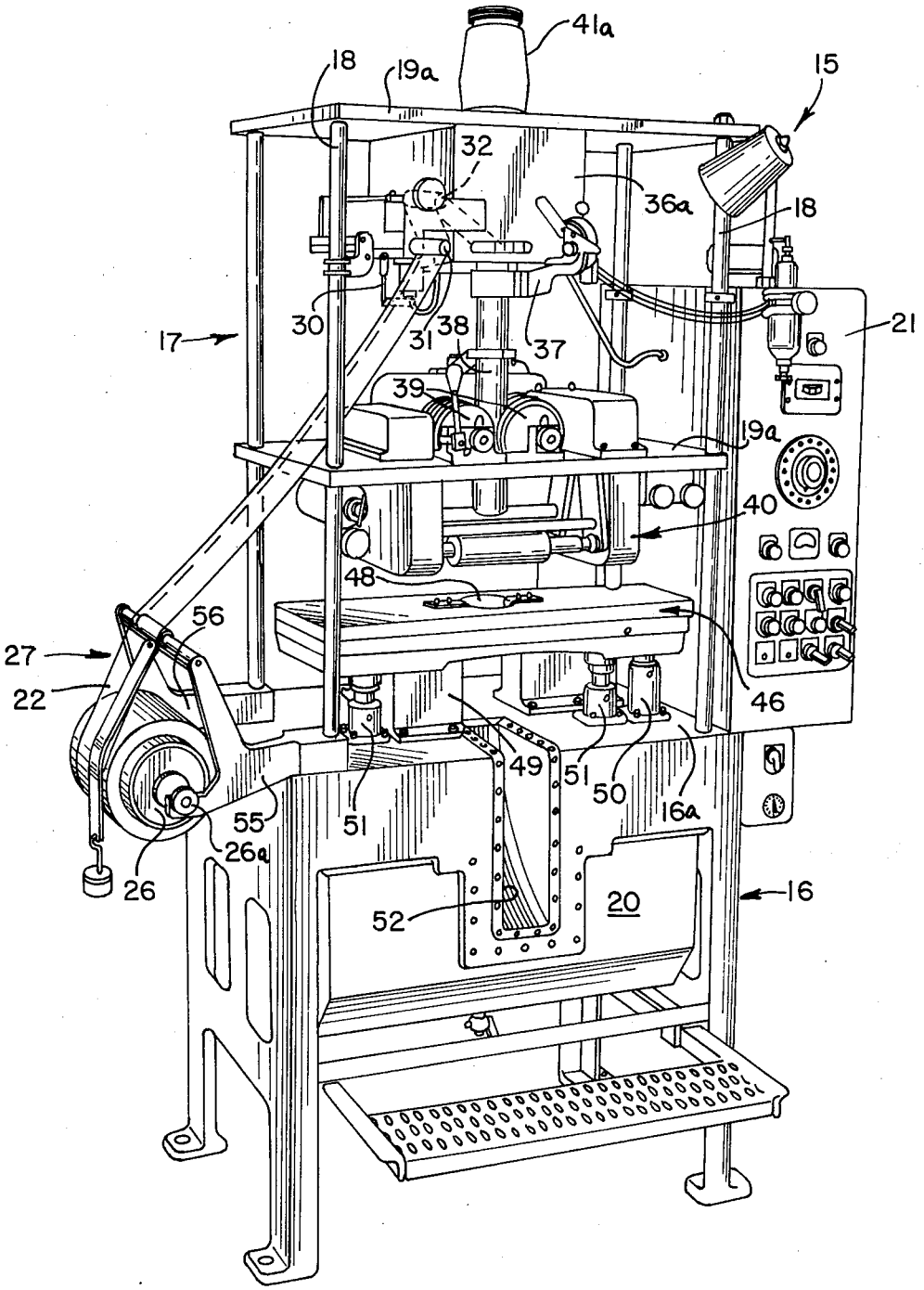
FIG. 1 is a perspective view of a complete package forming and filling apparatus representing one embodiment of the invention and including the improvements thereof.
Figure 5:
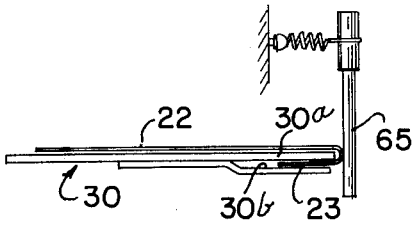
Figure 3:
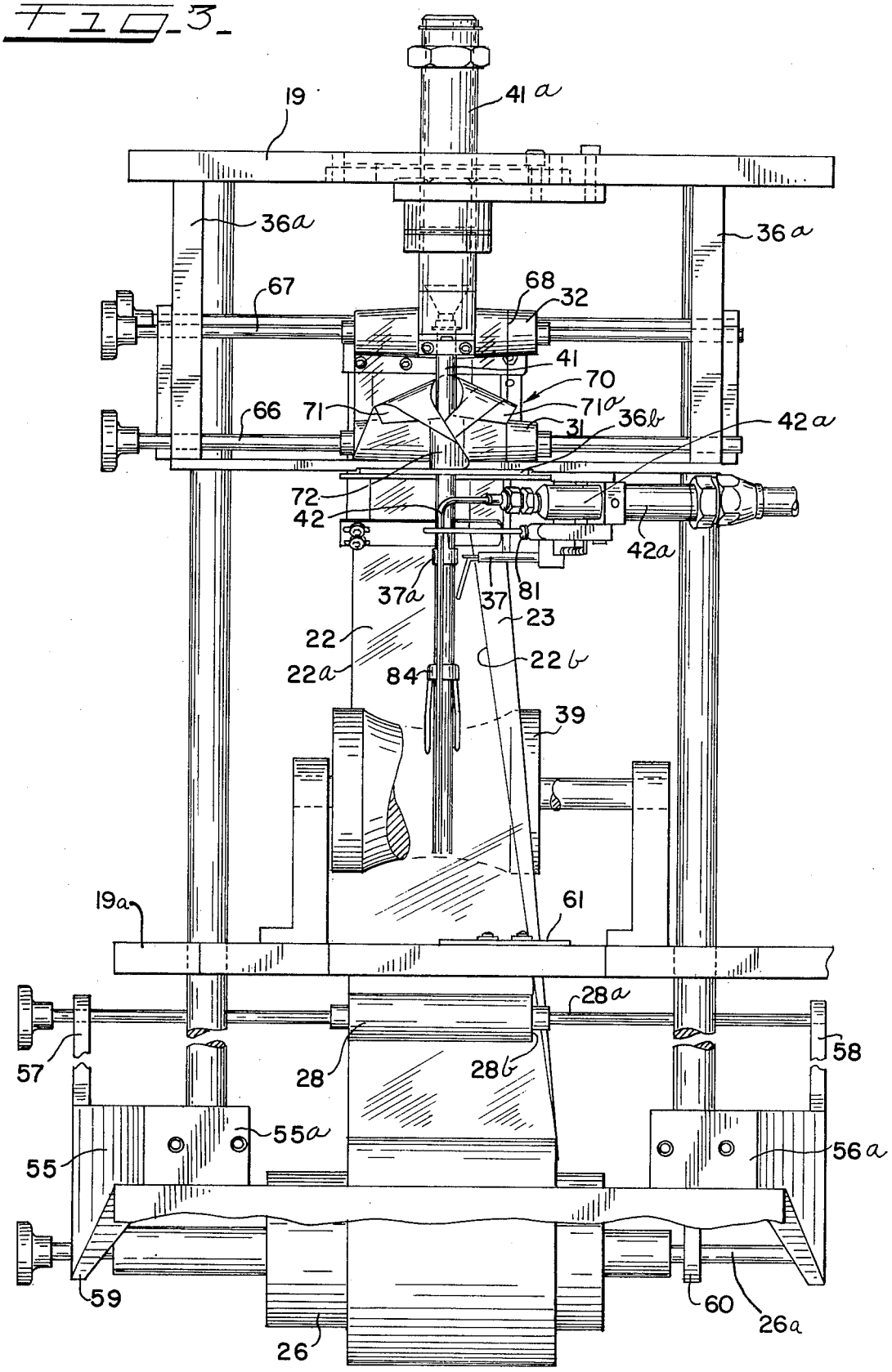

FIG. 3 is a side-elevational view, with certain parts removed for clarity of the improved portion of the apparatus shown in FIG. 2 which continuously folds the web of thin pliable film material into the dual compartment tube;

FIG. 4 is a fragmentary detailed perspective view of the improved film folding apparatus and tube filling apparatus shown in FIGS. 2 and 3;

FIG. 5 is a side-elevational view of a continuously formed dual compartment package (the subject matter of application Ser. NO. 628,447) which is formed in the apparatus of the invention;

FIG. 6 is a cross-sectional view of the film folder, film, and filling mandrel taken substantially along line 6—6 of FIG. 4;

FIG. 7 is a cross-sectional view of the dual filling mandrel apparatus with the continuous tube folded therearound taken substantially along line 7—7 of FIG. 4;

FIG. 8 is a cross-sectional view taken substantially along line 8—8 of FIG. 4;

FIG. 9 is a cross-sectional view of the dual compartment package taken substantially along line 9—9 of FIG. 5;

FIG. 10 is a detailed plan view of a first modification of the apparatus of the invention originally shown in FIG. 1 which includes an apparatus for applying slits to a portion of the film which when folded forms the inner second compartment of the continuously formed tubular package;

FIG. 11 is an end-elevational detailed view of the slit making apparatus taken along line 11—11 of FIG. 10;

FIG. 12 is an elevational detailed view of a second modification of the invention originally shown in FIG. 1 which includes a means for applying minute puncture holes to the portion of the web which as folded, forms the second or inner compartment of the package; and FIG. 13 is an end-elevational view of the second modification of the apparatus taken along line 13—13 of FIG. 12.

Referring to FIG. 1, the apparatus for continuously forming a plurality of multi-compartment packages is generally indicated at 15. Apparatus 15 includes a lower framework, generally indicated at 16, which is made of sheet metal reinforced by forming the same into a rectangular box-like structure. On top of the lower framework is mounted an upper frame structure, generally indicated at 17, which includes a plurality of tubular side members 18—18, each extending upward from one of the four corners of the lower frame 16. Tubular side members 18—18 are reinforced by a plurality of bulkheads or upper and lower mounting panels 19–19*a*, respectively, connected to the members so as to extend horizontally therebetween. The motor and drive mechanism (not shown) for operating a substantial portion of the apparatus are mounted inside the lower frame 16 and positioned behind the bottom cover enclosure 20. An electrical cabinet 21 is mounted to one side of the upper frame structure 17 and includes instrumentation and controls for operating the apparatus.

The various functional portions making up the apparatus of the invention may best be described by following the path of travel of a web or film 22 of plastic material as it passes through the machine to form that web into the outer layer of the compartments in the package 25 (FIG. 5). The plastic web 22 is continuously unwound from a supply roll 26 of such material which is rotatably mounted through its axis 26*a* to a film roll holder 27. Web 22 includes parallel side edges 22*a*, 22*b*, respectively. Film roll holder 27 is rigidly mounted to a pair of the vertical tubular supports 18—18 on the side of the apparatus opposite that side to which the electrical cabinet 21 is mounted. The film roll holder 27 is positioned on supports 18—18 so as to rest upon on the top surface 16*a* of lower frame 16.

A short guide roller 28 is rotatably mounted on film roll holder 27 in a position spatially above film roll 26 and generally parallel to its axis. Web 22 passes over short guide roller 28 as it is withdrawn from film roll 26. The short guide roller 28 does not extend completely across the side of film web 22. One side edge of roller 28 is positioned mediate the side edges 22*a*, 22*b* of film web 22 as the web moves over the roller thereby causing a marginal strip 23 of the web to begin to fold under the remainder of the web. The short guide roller will be discussed in greater detail below.

The film web 22 then moves upwardly on an incline toward the top center of apparatus 15 where it is passed through a film fork 30. Film fork 30 (FIG. 2*a*) positions the film web 22 in proper registration with the remainder of the package forming apparatus and assures that the marginal strip 23 of film web 22 is of correct dimensions and is completely folded under the remainder thereof (FIG. 2). After passing through the film fork 30, film web 22 is guided in a serpentine path over a pair of crowned rollers 31–32 which maintain the film web in taut condition, crease the fold in film web 22 in its proper position, and keep the web in proper registration with the remainder of the apparatus 15. The film web 22 then proceeds under a cylindrical roller 35 (FIG. 4) and thence into the tube former 36 which ends the film web across its width until it is tubular in shape. The tube forming action will be discussed in more detail below. The tube former 36 is secured to a cross-member 36*b* which is mounted between opposed frame supports 36*a*–36*a*. The opposed supports 36*a*–36*a* are in turn mounted to the bottom of the upper bulkhead or mounting panel 19*a* of upper frame 17. Upper panel 19*a* also serves as a protective canopy which prevents the entry of falling particles into the apparatus.

After the film web 22 has passed through the tube former 36, it proceeds downwardly past a film sealer 37 (FIG. 1) which is positioned below the bottom of the tube former 36 in spatial relation thereto. In film sealer 37, a hot-air jet forms a heat seal between three longitudinal segments of the film web 22 which have been folded and brought into interengaging registration. The film sealer 37 creates a single multi-layer seal (to be discussed below) thereby longitudinally completing a dual compartment continuous tube 38 formed from web 22. This tube 38 then passes through a pair of film drive rollers 39—39 which provide the force to move the film web and tube through the entire apparatus 15. The film drive rollers 39–39 are mounted on the top of intermediate bulkhead or mounting panel 19*b*, which is part of upper frame 18. The bottom distal ends 43, 44, (FIGS. 1 and 2) of large and small mandrels, 41, 42, respectively, around which the compartments of the tubular member 38 are folded and sealed, extend below drive rollers 39—39. As the tube 38 passes the open ends 43, 44 of large and small mandrels 41, 42, respectively, each compartment in the tube is filled with a differing substance which is packed therein through one of the individual mandrels.

A voiding mechanism 40, which is mounted on the bottom of intermediate bulkhead 19*b*, is positioned to operate below the open ends 43, 44 of the respective large and small mandrels 41, 42. The voiding mechanism 40 is capable of squeezing tube 38 in registered intervals immediately below the bottom of the mandrels 41, 42 to provide voided areas for gathering and clipping. The voider 40 is utilized if the product is highly viscous to prevent damage to the filled tube 38 during gathering and clipping. Below the voider 40, and movably mounted on the top surface 16*a* of lower frame 16, is the closure head mechanism 46. The closure mechanism 46 may be similar in structure to that described in U.S. Pat. No. 3,795,083 issued on Mar. 5, 1974 to the assignee of the present invention.

The closure head mechanism 46 is reciprocable vertically, within limits, and is capable of gathering the filled tubular member 38 at desired positions along its length, crimping pairs of clinching clips 47–47 (FIG. 5) around each gathered portion, and then severing the gathered portion at a position mediate each of the clips 47—47 clinched therearound to simultaneously form one end of each package 25. Next, the tube 38 moves downwardly through the hollow center 48 of the closure head mechanism 46 until the desired length of package 25 is obtained. Then, the closure head mechanism 40 again gathers the tubular member 38 at that desired position, applies a pair of closure clips 47—47 tightly therearound, and severs the tube 38 between each clip 47 of the pair thereof, thereby forming a completed dual compartment package 25. The closure clips 47 are formed from a coil supply of wire (not shown) positioned inside the wire cut-off unit 49 (FIG. 1). The formation of a U-shaped clinching clip from a coil of wire is disclosed in U.S. Pat. No. 3,793,688, issued on Feb. 26, 1974 to the assignee of the present application. The vertical movement of the closure head mechanism 46 is produced by two elevating shafts 50—50 (one not shown) which are reciprocated by cams (not shown) mounted inside the lower frame 16 and behind bottom cover 20.

Each completed package 25 exits the apparatus 15, after it is severed from the tube 38, by falling through and sliding down the central slot or chute 52 in lower frame 16.

Referring to FIGS. 2 and 3, the portion of the apparatus 15 which includes applicants' improvement is shown in greater detail. The improved portions of the apparatus 15 are either mounted on or positioned inside of upper frame 17. The film roll holder 27 includes a pair of parallel side arms 55 and 56. Each member has a base 55*a*, 56*a*, respectively, which rests on the top surface 16*a* of lower frame 16. The bases are each mounted on one of the vertical tubular supports 18—18 which extend upwardly from lower frame 16. The distal end of each of the roll holder side arms 55, 56 is bifurcated and includes an upper fork 57–58 and a lower fork 59–60, respectively. The upper arm forks 57–58 provide at their distal ends for rotatably mounting therebetween the shaft 28*a* on which short roller 28 is positioned. The lower arm forks 59–60 are provided at their distal ends with means for rotatably mounting the shaft 26*a* on which the roll 26 of film web material is rotatably mounted. As a web of film material 22 is withdrawn upwardly from the film roll 26 and into the tube former 36, the web 22 passes over the roller 28, film finger 61, and through film fork 30. The roller, finger and film fork act jointly to fold a marginal side strip 23 of the film web under the remainder of the web.

The fold in web 22 is begun when the web passes over short roller 28, shown most clearly in FIG. 3. The film roll 26 and guide roller 28 are aligned so the side edge 22*b* of the web extends over one end 28*b* of the short roller 28 as the web passes thereover. The tension on web 22 caused by the pull from the film drive rolls 39—39 co-acts with the annular outer edge of the end 28*b* of guide roller 28 to cause the marginal strip 28 to start folding below the remainder of the web. Next, film web 22 passes over a stationary L-shape film finger 61 which further turns marginal strip 23 under the remainder of the web. Further, the marginal strip 23 is completely folded under the remainder of film web 22 as the web is passed through film fork 30, which is most clearly shown in FIG. 2*a*. The film fork 30 includes a flat upper surface 30*a* over which the major part of film web 22 rides, and a slot portion 30*b* underneath flat surface 30*a* and in which the marginal strip 23 is positioned under the remainder of the web. The folded web is restrained and guided through the film fork 30 by a pressure rod 65 which extends across the opening of the film fork slot 30*b*.

After the film web 22 passes through the film fork 30, the marginal side strip 23 is completely folded under the remainder of the web. The web then passes into that part of the apparatus 15 which forms the folded web into the continuous tube 38. The tube former 36 is shown in FIGS. 2, 3, and is isolated perspective detail in FIG. 4. The opposed frame supports 36*a*–36*a*, to which the tube former 36 is mounted through cross-member 36*b*, also support other parts of the apparatus. The pair of crowned rollers 31 and 32 are rotatably mounted between supports 36*a*–36*a* on shafts 66 and 67, respectively. The shafts are positioned in horizontal, parallel and spatially related orientation to each other. Rollers 31 and 32 are crowned, i.e. of larger diameter at their centers than at their ends to provide added tension to the film web 22 so that it will not wander horizontally from side to side while passing thereover. The crowned rollers also firmly crease the web at the fold line 68. After proceeding over crowned rollers 31 and 32, the folded web then passes under a cylindrical roller 35 which is positioned immediately rearward and subjacent the tube former 36.

The tube former 36 is a collar-like arrangement most resembling a bib collar on a navy seaman's uniform, which includes a pair of outwardly and slightly downwardly sloping rounded shoulders 71–71*a* on either side of a vertical hollow neck 72. The nct 72 joins shoulders 71–71*a* along a line 75 which is oval in shape at its apex on the upper back of shoulders 71–71*a*. From its apex, line 75 curves downwardly and forwardly to the front of neck 72 where each end of the line 75 crosses the other in skewed spatial relation as the front ends of neck 72 overlap each other. The bottom of neck 72 extends below shoulder 71–71*a*. The web 22 is positioned in a convex relation as it is drawn over the shoulders 71–71*a*, and the middle of the web is drawn into the hollow interior of neck 72 first. As the web 22 is moved into the inside of neck 72, the shape across its width is changed to a concave form as the outward portions of web 22 pass over the juncture line 75. The side edges 22*a*, 22*b* and crease 68 of web 22 pass over juncture line 75, at the front lower portion of shoulders 71–71*a* near the skewed overlapping ends of same. The side edges of web 22 are overlapped in tube former 36 such that the folded marginal strip 23 is positioned interiorly adjacent side edge 22*a* which overlaps the marginal strip 23 until it is parallel with and outwardly adjacent of side edge 22*b*. The relative positions of the neck 72, the marginal strip 23 of web 22, and side edges 22*a*–22*b* and crease 68, are shown most clearly in FIG. 6.

A relatively large tubular mandrel 41 extends vertically through the hollow interior of neck 72 on the tube former 36, in spatial relation thereto. The large mandrel 41 is a hollow tube through which the first substance 76 flows before being inroduced in the large compartment of the dual compartment tubular package 25. Large mandrel 41 extends downwardly from an enlarged section 41*a* which is in turn connected to a pump or other continuous feeding device (not shown). The pump propels the first substance 76 at an adjustable rate through the mandrel 41. The mandrel 41 extends downwardly past the bottom of neck 72 wherein an indentation 77, which in this particular embodiment of the invention approximates one quarter of the cross-section of mandrel 41, is formed along the remainder of the length of large mandrel 41. At the bottom 43 of large mandrel 41, the substance 76 discharges from the mandrel and enters into the large compartment of the tube 38, which has been formed therearound.

As the web 22 leaves the bottom of neck 72, it moves downwardly over the indented portion 77 of large mandrel 41. The side edge 22*a* and marginal strip 23 are temporarily moved outwardly of the portion of web 22 over which they were overlapped to move across the top of an elbow 79 on a relatively small mandrel 42. Below elbow 79, small mandrel 42 is positioned in the folded dual-ply portion of the web 22 which will subsequently be formed into the small compartment of tubular package 25 into which second substance 80 will be positioned. A cross-section view of tube 38 (before sealing), large mandrel 41, and small mandrel 42 is shown at the level of elbow 79 in FIG. 7. Small mandrel 42 is nested in the indentation 77 in large mandrel 41 for the remainder of the length of both mandrels below the elbow 79.

After both the side edges 22*a*, 22*b* of tube 38 pass to the outside of elbow 79 in small mandrel 42, they are moved inwardly to their previous positions by a curved tip finger 81 which is pivotally mounted to the bottom of the small mandrel feed mechanism 42*a* and biased in position.

After the unsealed tube 38 has passed elbow 79 and the curved finger 81, the tube 38 passes into the film sealer 37, most clearly shown in FIG. 1. A tube sizing ring 37*a* (FIGS. 2 and 3) is positioned around the outside of large mandrel 41. Both the ring and the large mandrel pass through the inside of the large compartment of the tube 38. An air jet 84 (FIG. 8) directs a stream of hot air onto the outside of the triple-ply portion of the tube 38 (position B in FIG. 8) immediately adjacent side edges 22*a* and 22*b* after major diameter of tube has been established by passing over tube sizing ring 37*a*. This hot air stream seals the three layers of the tube together along its length in one composite sealing formation, generally designated at 85. This composite seal 85 closes the large compartment around the outside of the smaller compartment. The small compartment is attached to the inside of the large compartment along the length of seal 85. The composite seal 85 is such that should it ever fail, the materials in either the small or large compartment will flow outwardly of the package and not mix with the substance in the other compartment in package 25. Since a preferred use of the package 25 includes reactive substances placed in the separate compartments, this construction prevents accidental reaction between the substances when such reaction is no desired.

After the composite seal 85 is formed, sealed dual compartment tube 38, proceeds downwardly from the sealing ring, as is most clearly shown in FIG. 8, with stationary large mandrel 41 inside the large compartment and stationary small mandrel 42 inside the small compartment of the tube. A film spreader 84 (FIGS. 2 and 3) is mounted to the large mandrel 41 below the tube sizing ring 37*a* to feed the tube uniformly into the film drive rolls 39—39. As the tube 38 leaves the bottom 78 of large mandrel 41 and the bottom 86 of small mandrel 42, the differing substances are positioned in each compartment thereof.

After the tubular member 38 has been filled with differing substances in each compartment, it passes downwardly into the closure head mechanism 46 which sequentially gathers portions of the filled tube, applies pairs of clinching clips 47 therearound, severs the tube between the clinching clips to produce each package 25, substantially as is shown and described in U.S. Pat. No. 3,795,083. After the package 25 is completely formed, it exits the apparatus 15 by sliding through slot 52 in the bottom frame portion 16 of the machine. The cut-off may also be performed externally in order to avoid possible contamination of the clipping mechanism by reactive products.

Apparatus 15 is constructed so that packages 25 are made continuously therein and the length of each package may be varied by changing the interval at which the closure head mechanism 46 operates. The diameter of the first and second compartments of the package 25 may be varied by changing the relative sizes of the first and second mandrels 41 and 42, respectively, the diameter of tube sizing ring 37*a*, and also changing the widths of the web 22 and marginal strip 23.

A package 25, as it appears after completion, is shown in FIG. 5 with a cross-section of it shown in FIG. 9. A more complete description of the package of the invention may be found in the co-pending application Ser. No. 628,477, filed Nov. 4, 1975, and having a common assignee with the present application.

The package 25, as shown in the cross-sectional view in FIG. 9, has a large and a small compartment, preferably including differing substances 76 and 80 in the respective compartments. As the thickness of web 22 is uniform, both compartments have relatively equal burst strength. In a preferred mode of operation, the package 25 is utilized for containing a resin and a catalyst in the separate compartments. These two substances are intended to be combined after the package is positioned in an enclosed space, such as a drillhole in a rock formation, by bursting or smashing the package with the device to be secured in the drill-hole, such as a shaft or bolt. When the package is smashed or burst open, it may be desirable that the inner small compartment burst inwardly into the large compartment to provide uniform mixing of the differing substances. In FIGS. 10–13, two embodiments of a mechanism are shown which are capable of reducing the burst strength of the inner small compartment of package 25.

The first such embodiment generally indicated at 87, is a slitting mechanism shown in FIGS. 10 and 11 which is positioned at the bifurcated side of the previously described film fork 30. The slitting mechanism 87 includes a knife 88 which is pivotally mounted at 90 to a supporting frame 89 which is substituted for the original film fork mount. Mounting the knife pivotally allows its dual cutting edges 91—91 to move up and down through vertical slots 92 (slot 92*a* is not shown) which is positioned through both of the bifurcated ends 30*a* and 30*b* of film fork 30. The short vertical pivotal movement of knife 88 is controlled at its base end by pivotal connection to a motive power source 95, which may be a hydraulic or pneumatic cylinder, a solenoid, or the like. The knife 88 is positioned such that the slits 96—96 are made across the crease 68 of marginal strip 23. Therefore, when the dual compartment package 25 is formed, slits 96–96 are positioned at the innermost portion of the small compartment. The slits 96—96 weaken the sidewall of the inner compartment so that it bursts before the outer compartment bursts when the package is smashed. When the inner compartment bursts first, the substance 80 in the smaller compartment is forced into reaction with substance 76 in the large compartment.

The slits 96—96 can be cut in even or uneven distribution along the length of the package 25. An uneven distribution with the slits positioned only in the gathered portions at each end of the package 25 may be desired. Also, the position of knife pivot point 90 on frame 89 is variable to allow the length of the slits 96 to be increased or decreased. The length of slits 96—96 should be sufficiently short such that leakage of the substance from one compartment to the other does not occur before a desired external pressure is applied to the package, i.e., before the package is smashed. Also, positioning the slits 96 solely in the gathered portions of the package 25, where less of the substances and more of the web material is located, helps to prevent the possibility of leakage of the substances from one compartment to the other.

The second embodiment is a pinwheel apparatus, generally indicated at 97, in FIGS. 12 and 13. This second apparatus makes minute holes in the web 22. The pinwheel apparatus 97 is mounted so as to sit on top of the roll 26 of the film web 22. As the roll turns, the apparatus also turns and makes a plurality of holes 97*a* in web 22 at approximately the position where crease 68 will be when it is formed. The apparatus 97 includes a pinwheel 98 having a plurality of needles 99–99 positioned in equally spaced relation and around the outer circumferences of the wheel in a plane perpendicular to the wheel axis. The pinwheel 98 is rotatably mounted through sleeve 98*a* mediate the ends of a shaft 100. In order to correctly position the pinwheel 98 on the top of roll 26, while the roll is played out, the ends of shaft 100 each contain a pinion gear 101—101. The pinion gears are positioned in meshing relation with a pair of vertical rack gears 102—102, respectively. The rack gears are each vertically mounted to one of a pair of mounting brackets 105—105 which are secured to upper frame members 18—18, above the film roll holder mountings. At the outer side of each mounting bracket 105, a slot 106 is positioned parallel to rack gear 102 such that the ends of shaft 100 ride therein. The combination of the slots 106 along with rack gears 102—102 and pinion gears 101—101 allow the pinwheel 98 to both move vertically and rotate freely and keep the pinwheel axis parallel to film roll axis 28*a*. The dimensions of each puncture hole 97*a* and the spacing between puncture holes can be determined by the configuration of the needles 99 on the pinwheel 98. Also, the weight of pinwheel 98 may be varied to change the depth of the puncture, i.e., change the hole diameter. In the preferred embodiment of the package 25, the hole diameter will not be sufficient to allow the free movement of the substance in one compartment into the other compartment until such time as the stress within the small compartment is sufficient to break the compartment sidewall along the puncture line.

While a particular embodiment and variations of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed as new is:

1. In an apparatus for continuously forming a series of packages of the type including a multiple compartment tube made from a single web of pliable film which is formed into said tube, filled with differing substances in each compartment, gathered at two positions along its length, sealed at each gathered portion by pairs of closure clips clinched therearound, and severed between the closure clips in each pair thereof; said apparatus comprising:

means for folding a portion of said web adjacent one side edge thereof over upon the remainder of said web forming a two-ply margin:

means for forming said web into a continuous tube with the opposing side edge of said web being on the outside thereof and overlapping said two-ply margin until said one side edge and said opposing side edge are in engaging registration;

means for sealing together said two-ply margin and said opposing side edge with a single composite seal to form two separate compartments in said tube;

means for filling each compartment in said continuously formed tube with a differing substance, and means for gathering portions of said tube and clinching pairs of closure clips around said gathered portion.

2. The apparatus called for in claim 1 further including means on said apparatus for severing said pliable film between said closure clips.

3. The apparatus called for in claim 1 further including means positioned externally of said apparatus for severing said pliable film between said closure clips.

4. The apparatus called for in claim 1 wherein said means for forming said two-ply margin include a roller positioned across the path of travel of said web, said roller including a cylindrical face across which a substantial portion of said web passes, said roller being aligned offset the path of travel of said web such that marginal portion of said web extends over the end of said roller, and said marginal portion folding inwardly of the cylindrical surface of said roller as it is drawn thereacross.

5. The apparatus called for in claim 1 wherein said means for forming said two-ply margin include a guide member including a finger portion across which said web passes with the side edges thereof positioned on opposite sides of said finger, and a distal end of said finger forming a fold in said web, said fold being parallel said web side edges, and means co-acting with said finger portion for aligning said web with said finger to properly position said fold on said web.

6. The apparatus called for in claim 1 wherein said continuous tube forming means includes a neck having a hollow interior through which said web is drawn, said web being formed to the shape of said neck interior as it is drawn therethrough, said neck having a pair of rounded sloping shoulders extending outwardly and downwardly from opposing sides of the top thereof, and said shoulders being guides for the orderly feeding of said web into the interior of said neck.

7. The apparatus called for in claim 1 wherein said means for filling said continuous tube include a first tubular mandrel for feeding a first substance therethrough into a first compartment in said continuous tube, said first mandrel extending through said continuous tube forming means, whereby, said continuous tube is formed therearound and said first substance exits the bottom end of said first mandrel and is positioned in said first compartment in said tube, said first mandrel including an elongate indentation therein, said indentation being parallel the axis of said mandrel and extending to the bottom end thereof, and a second tubular mandrel for feeding a second substance therethrough into a second compartment in said continuous tube, said second mandrel extending into the space defining said indentation in said first mandrel at a position subsequent said tube forming means on the path of travel of said tube and nesting in said indentation in aligned relation therewith, whereby, said two-ply margin of said tube extends around said second tubular mandrel and said second substance exits the bottom of said second mandrel and is positioned in said second compartment in said tube.

8. The apparatus called for in claim 1 wherein said means for sealing engagement include a hot air jet positioned to direct hot air onto said overlapping two-ply margin and opposing side edge for sealing same together.

9. The apparatus called for in claim 1 further including means for decreasing the burst strength of a compartment in said package formed from said two-ply margin, said burst strength decreasing means including mechanism for producing minute holes in spaced relation along the length of said web in a portion of same forming said two-ply margin.

10. The apparatus called for in claim 9 wherein said mechanism includes a pinwheel assembly positioned to rotate and ride on said web of pliable film, said pinwheel assembly including a drum with needles spatially positioned around the circumference thereof so as to puncture said web as said drum rides thereon.

11. The apparatus called for in claim 9 wherein said mechanism includes a slitting assembly including a knife having a cutting edge which is mounted along the path of travel of said web adjacent the fold or crease in said two-ply margin of said web, said knife being movably mounted for slitting said web across said crease.

12. In an apparatus for continuously forming a series of packages of the type including a multiple compartment tube made from a single web of pliable film which is formed into said tube, filled with differing substances in each compartment, gathered at two positions along its length, sealed at each gathered portion by pairs of closure clips clinched therearound, and severed between the closure clips in each pair thereof; said apparatus comprising:

means for folding a portion of said web adjacent one side edge thereof over upon the remainder of said web forming a two-ply margin;

a tube former including a neck having a hollow interior through which said web is drawn, said web being formed to the shape of said neck interior as it is drawn therethrough, said neck having a pair of rounded sloping shoulders extending outwardly and downwardly from opposing sides of the top thereof, and said shoulders being guides for the orderly feeding of said web into the interior of said neck;

means for sealing together said two-ply margin and said opposing side edge with a single composite seal to form two separate compartments in said tube;

a first tubular mandrel for feeding a first substance therethrough into a first compartment in said continuous tube, said first mandrel extending through said hollow interior of said neck, whereby, said continuous tube is formed therearound and said first substance exits the bottom end of said first mandrel and is positioned in said first compartment in said tube, said first mandrel including an elongate indentation therein, said indentation being parallel the axis of said mandrel and extending to the bottom end thereof, and a second tubular mandrel for feeding a second substance therethrough into a second compartment in said continuous tube, said second mandrel extending into the space defining said indentation in said first mandrel at a position subsequent to said neck on the path of travel of said tube and nesting in said indentation in aligned relation therewith, whereby, said two-ply margin of said tube extends around said second tubular mandrel and said second substance exits the bottom of said second mandrel and is positioned in said second compartment in said tube, and means for gathering portions of said tube and clinching pairs of closure clips around said gathered portion.

13. The apparatus called for in claim 12 further including means on said apparatus for severing said pliable film between said closure clips.

14. The apparatus called for in claim 12 further including means positioned externally of said apparatus for severing said pliable film between said closure clips.

15. The apparatus called for in claim 12 wherein said means for sealing engagement include a hot air jet positioned to direct hot air onto said overlapping two-ply margin and opposing side edge for sealing same together.

16. A method for continuously forming a series of dual compartment tubular packages made from a single web of pliable film material, said method comprising the steps of;

drawing said film material from a web thereof;

folding a marginal strip of said material under the remainder thereof to form a two-ply margin;

feeding said material over the shoulders and into the interior of a hollow neck in a film folder to form said web into a continuous tube with an opposing edge of said web overlapping said two-ply margin, said continuous tube being formed around a large tubular mandrel which extends through said hollow neck;

moving said opposing edge and said marginal strip outwardly of the remainder of said tube to provide for positioning a small tubular mandrel inside said two-ply margin;

returning said opposing side edge and said marginal strip inwardly to their previous position;

sealingly engaging together said opposing side edge and said two-ply margin with a single composite seal to form two sealed compartments in said continuous tube;

filling said compartments with substances flowing from said tubular mandrels positioned therein;

gathering said filled tube sequentially along its length;

sealing each gathered portion by clinching pairs of closure clips therearound; and severing said material between closure clips in each pair thereof.

* * * * *

UNITED STATES PATENT AND TRADEMARK OFFICE

CERTIFICATE OF CORRECTION

PATENT NO. : 3,992,854

DATED : November 23, 1976

INVENTOR(S) : Duane Aaron Howell and David G. Walton

It is certified that error appears in the above-identified patent and that said Letters Patent are hereby corrected as shown below:

In Column 6, at Line 32, "is" should be --in--;

In Column 6, at Line 53, "nct" should be --neck--;

In Column 8, at Line 9, "no" should be --not--.

Signed and Sealed this

Tenth Day of May 1977

[SEAL]

*Attest:*

RUTH C. MASON
*Attesting Officer*

C. MARSHALL DANN
*Commissioner of Patents and Trademarks*